US007316293B2

(12) United States Patent
Yao et al.

(10) Patent No.: US 7,316,293 B2
(45) Date of Patent: Jan. 8, 2008

(54) EXTENSION LADDER WITH IMPROVED MECHANISM

(75) Inventors: Kuo-Ching Yao, Lu-chou (TW); Norman William Liefke, 800 15355-24 ave, Surrey.B.C. (CA) V4A 2H9

(73) Assignees: Norman William Liefke (CA); Ching-Yao Kuo (TW)

( * ) Notice: Subject to any disclaimer, the term of this patent is extended or adjusted under 35 U.S.C. 154(b) by 36 days.

(21) Appl. No.: 11/435,135

(22) Filed: May 17, 2006

(65) Prior Publication Data

US 2007/0267252 A1 Nov. 22, 2007

(51) Int. Cl.
*E06C 1/00* (2006.01)

(52) U.S. Cl. ..... 182/195; 182/207

(58) Field of Classification Search ..... 182/195, 182/166, 207, 21–24, 228.1, 228.6, 165
See application file for complete search history.

(56) References Cited

U.S. PATENT DOCUMENTS 4,989,692 A * 2/1991 Min ..... 182/166
5,495,915 A * 3/1996 Weston et al. ..... 182/195
5,743,355 A * 4/1998 McDonnell et al. ..... 182/195
6,708,800 B2 * 3/2004 Kieffer et al. ..... 182/195
2004/0195043 A1 * 10/2004 Johansson ..... 182/195

* cited by examiner

*Primary Examiner*—Alvin Chin-Shue
(74) *Attorney, Agent, or Firm*—Lowe Hauptman Ham & Berner, LLP

(57) ABSTRACT

An extension ladder with improved mechanism includes a plurality of ladder sections, connection kits, locking mechanism, and transverse step portions; wherein each ladder section is a hollow rung, and the caliber of the rung becomes smaller when it is in a higher location. The upper ladder section and lower ladder section can be interconnected and fit each other; said connection kits are horizontally provided in the upper end of said ladder section. The internal part of said connection kit is provided with a locking mechanism to snap-fit into the through hole of said ladder section to secure the extension between each ladder section. The outside of said locking mechanism is covered by the transverse step portion, by the improved locking mechanism, the extension ladder can be assembled easily and firmly for providing superior safety to people, even when an external force is applied.

13 Claims, 9 Drawing Sheets

EXTENSION LADDER WITH IMPROVED MECHANISM

BACKGROUND OF THE INVENTION

1. Field of the Invention

The present invention relates to an extension ladder, and more particularly to an extension ladder, which can be assembled easily and firmly for providing superior safety to people.

2. Description of the Prior Art

It is noticed that stepladders have become a requisite tool for casual use. For example, climbing tools such as a ladder or scaffolding enable people to readily process construction or obtain the objects at a high place.

A conventional stepladder 800, as shown in FIG. 1, is assembled by two ladder units having a pair of footpads respectively installed at the lower end of the ladder section 811 to prevent slippage, and is provided with parallel spaced step plates 821 therein. The stepladder appears as an A-frame ladder during usage.

Stepladders are typically large and bulky; therefore, it is uneasy and inconvenient to carry them. Moreover, the storage of a folded stepladder may occupy large space, which makes the use of a stepladder inflexible.

Accordingly, the present invention has been invented to solve the above-mentioned problems occurred in the prior art.

SUMMARY OF THE INVENTION

Therefore, an object of the present invention is to provide an extension ladder with improved structure, which is composed of multi-segment ladder sections, connection kits, locking mechanism, and transverse step portions, providing ease and convenience to fold and take along, store, or unfold and use.

According to the extension ladder of present invention, the locking mechanism has further improvements, such that after the extension ladder is extended for people's uses, the ladder would not loose and cause danger. So as to confirm user's security, this is the second object of present invention.

In the extension ladder of the present invention, the connection kits and hollow rungs are locked in place, and then stuck and fastened. This prevents these components from loose and disattachment, which serves as another object of the present invention.

According to the extension ladder of present invention, the locking mechanism provided inside the connection kits are wrapped by transverse step beams, and can avoid the damage of rust, which serves as further object of the present invention.

The detailed structure, application principle, function, and effects of the present invention will be more apparent from the following descriptions taken in conjunction with the accompanying drawings.

DETAILED DESCRIPTION OF THE PREFERRED EMBODIMENT

Figure 1:
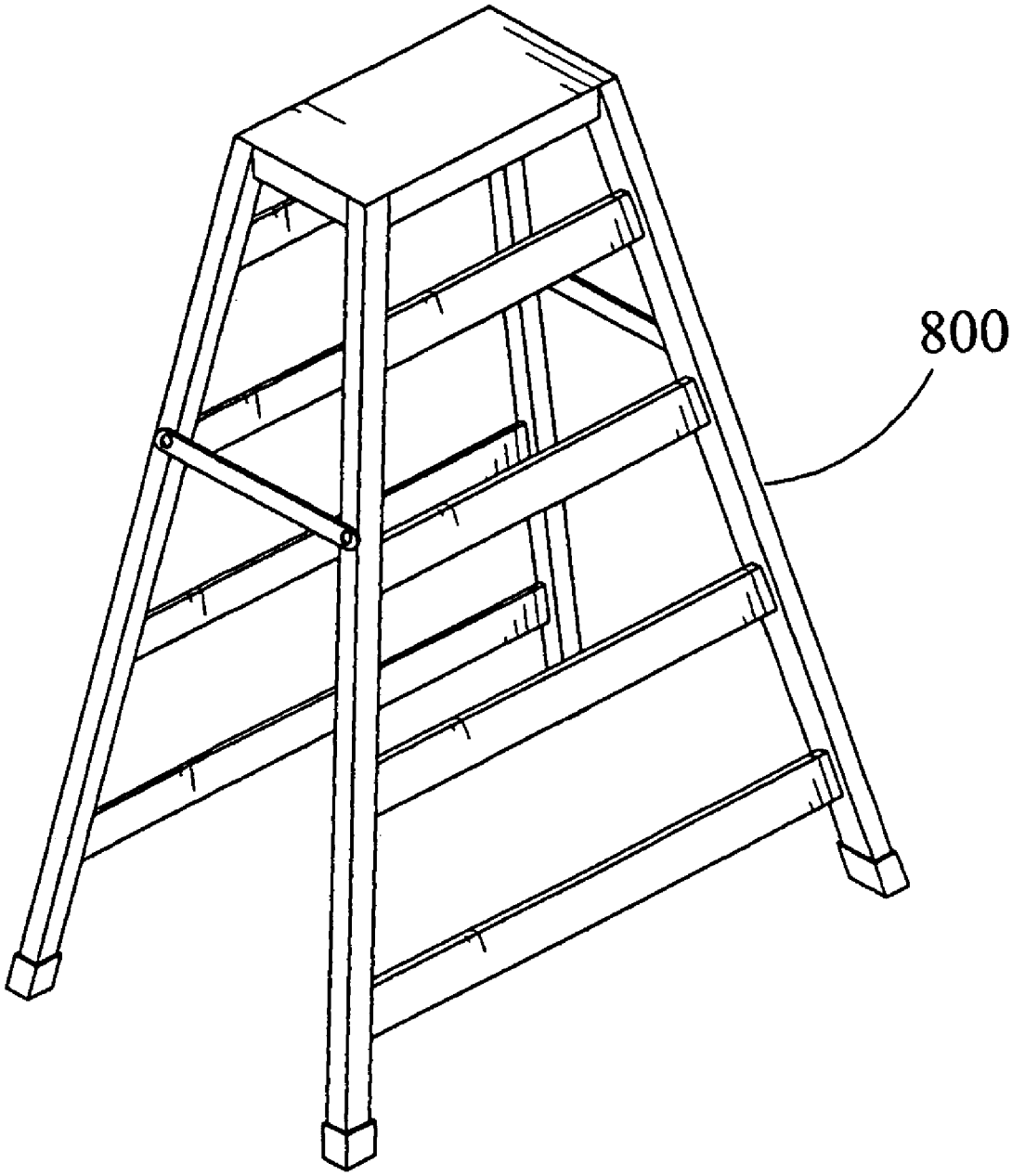
FIG. 1 is a three-dimensional view of the conventional extension ladder.
Figure 2:
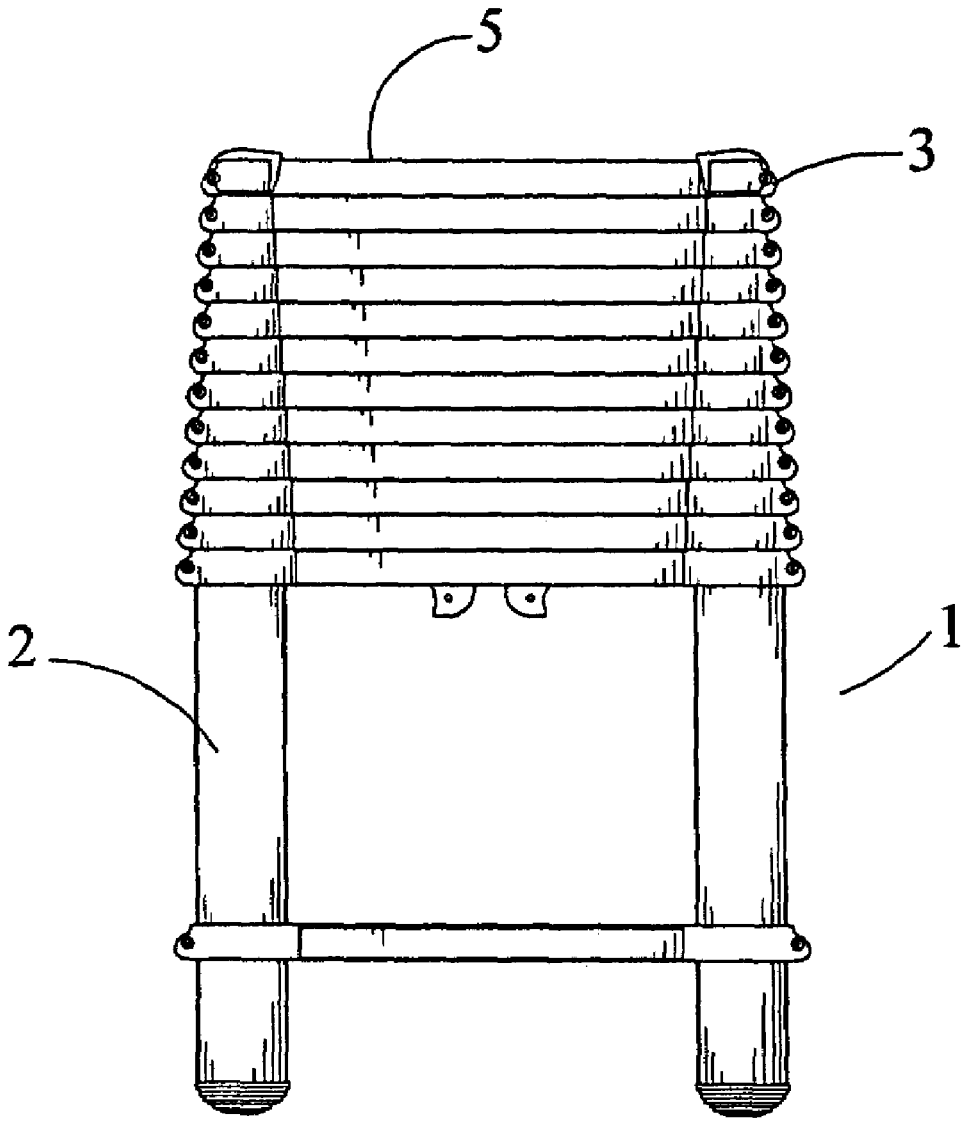
FIG. 2 is a front view showing the present invention before use.
Figure 3:
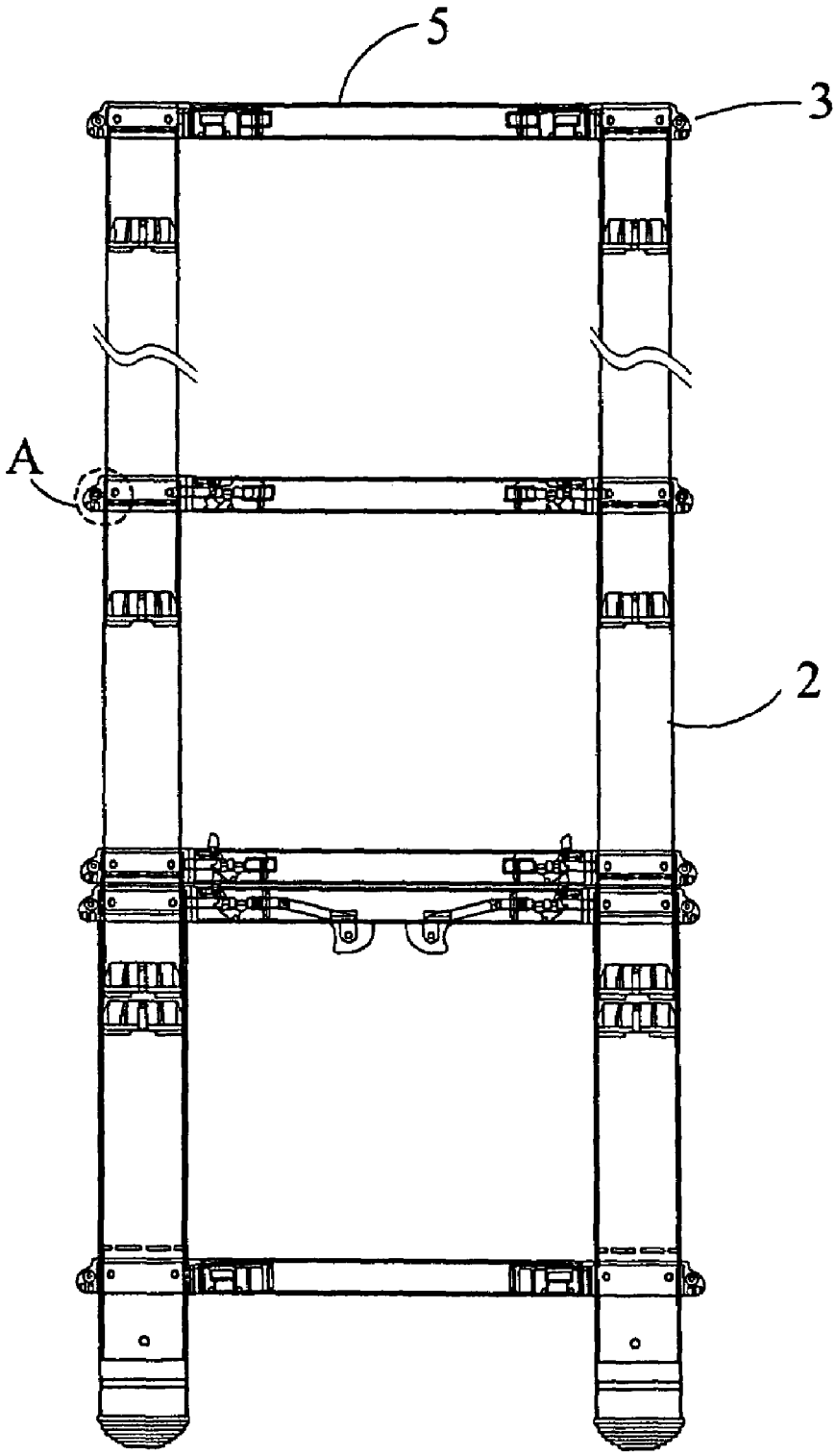
FIG. 3 is a front view showing the present invention has been extended for use.

The extension ladder with improved structure of the present invention, as shown in FIG. 2, wherein the extension ladder 1 is foldable, or unfoldable as shown in FIG. 3, includes a plurality of ladder sections, connection kits 3, and transverse step beams 5. The stepladder appears as a rising ladder when it is unfolded and used, and can be folded by fitting the ladder sections with different calibers one another.

Figure 4:
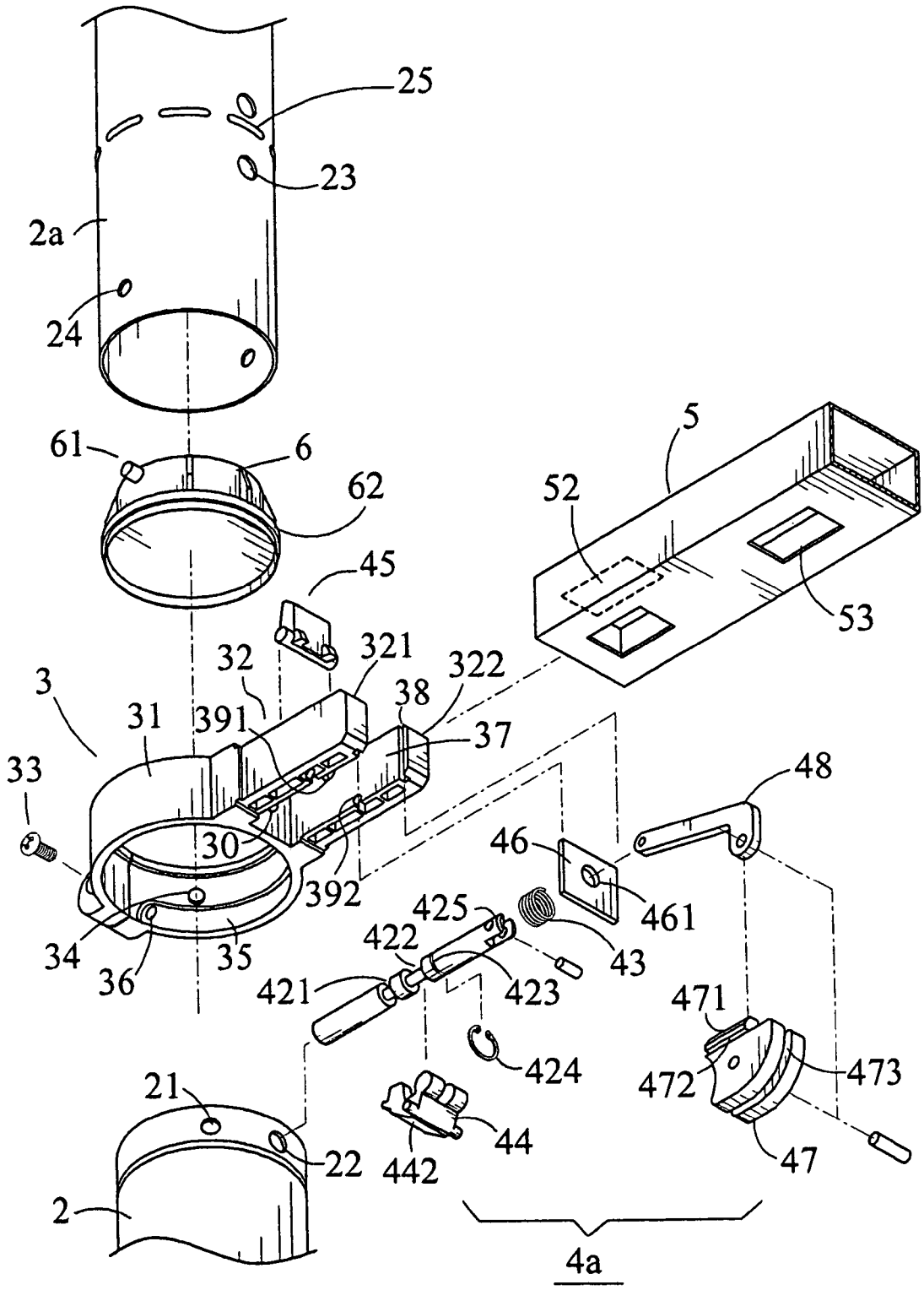
FIG. 4 is a three-dimensional exploded view showing the first ladder section and transverse step beam of the present invention.
Figure 5:
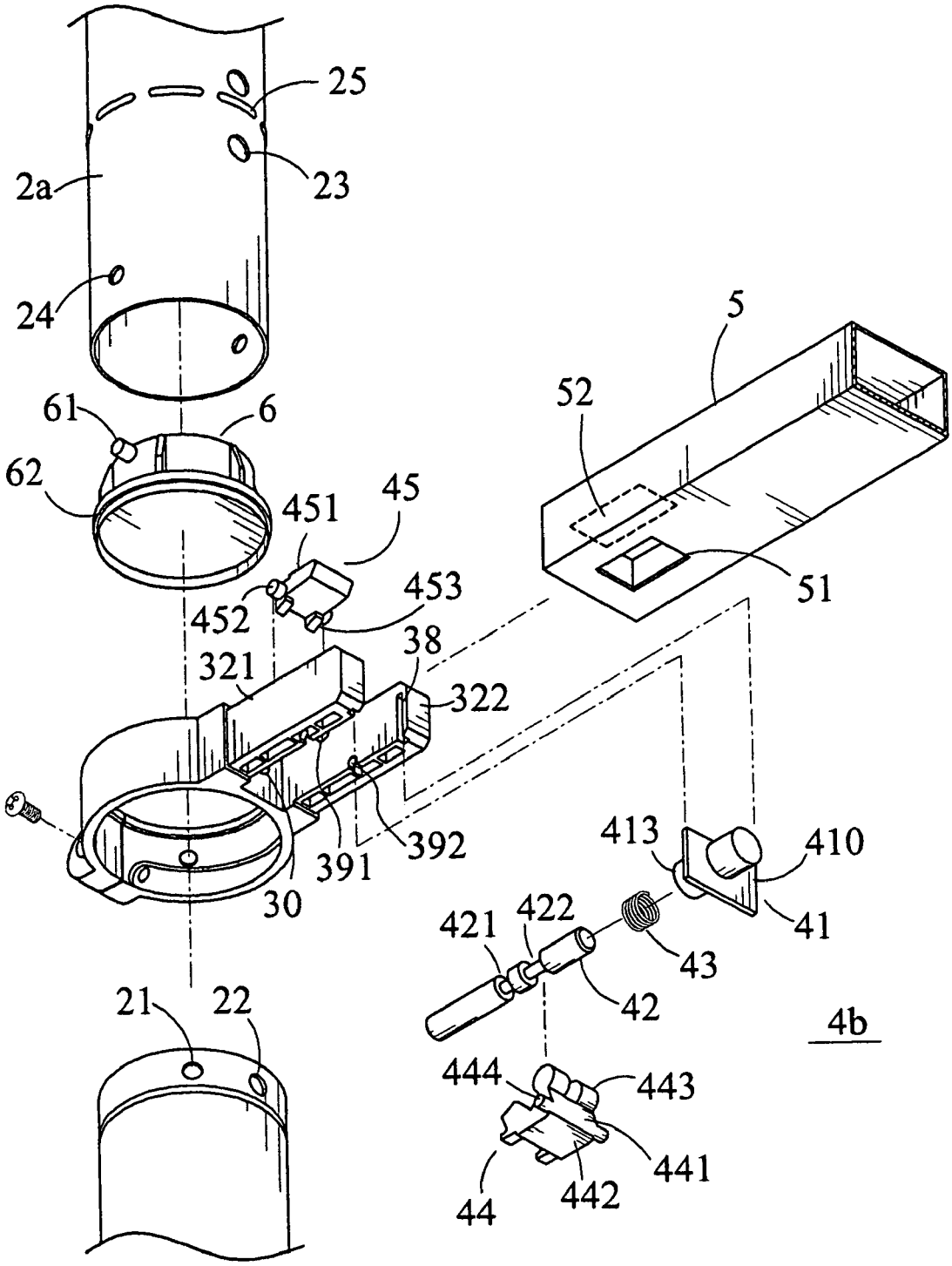
FIG. 5 is a three-dimensional exploded view showing the ladder section and transverse step beam in the present invention except the first ladder section.
Figure 6:
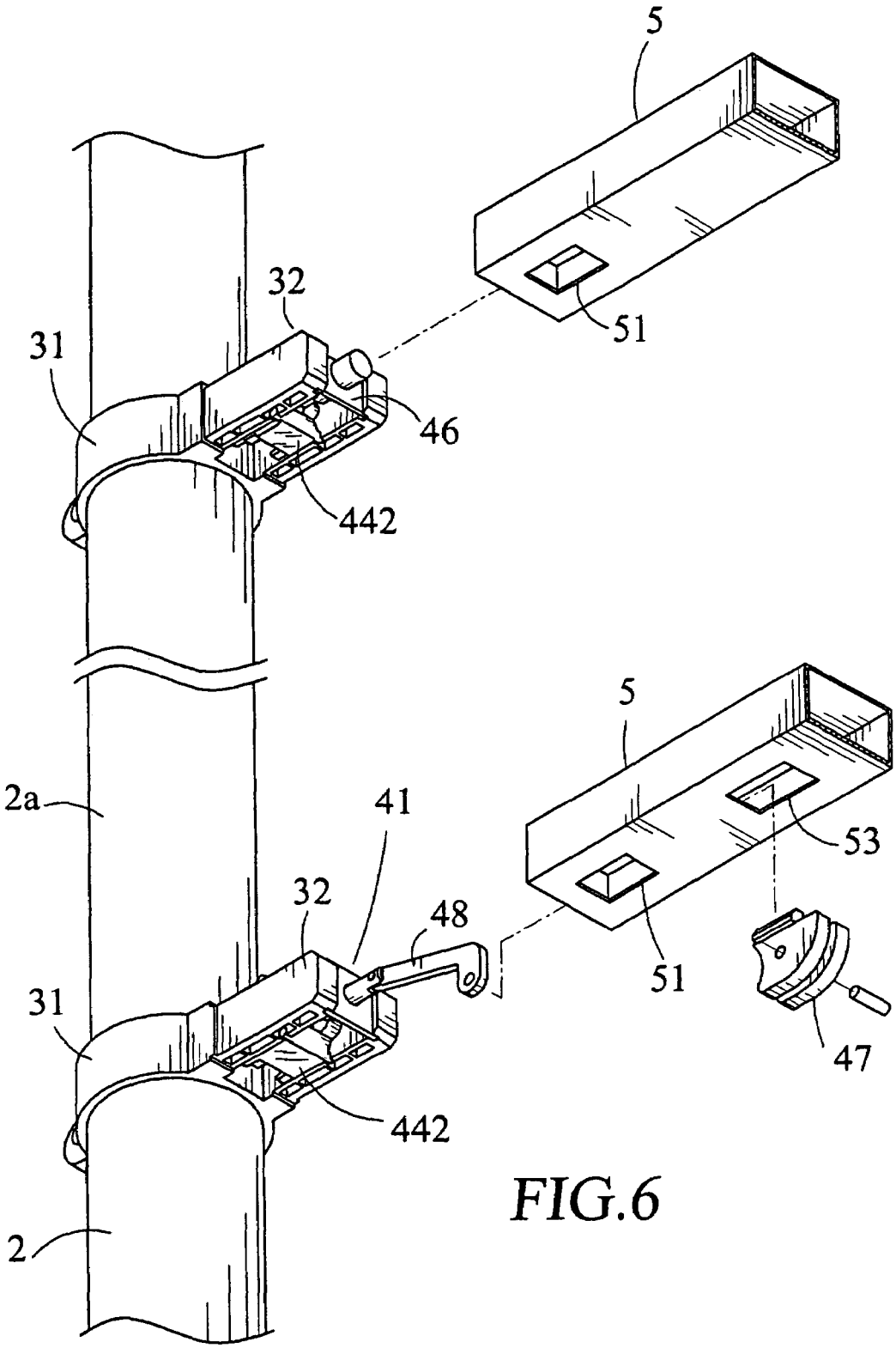
FIG. 6 is a three-dimensional assembly view showing the assembly of the construction of ladder section and transverse step beam of the present invention.

Referring to FIGS. 4, 5, and 6, such ladder section 2 fits each other by providing similar-shaped but smaller internal ladder section 2*a*. Said cannular-shaped ladder section 2 is provided with a snap-fit hole 21 and an orientation hole 22 on its upper end, and provided with a through hole 23 on its lower end. Also, an outward extruded blocking ring 25 is provided on the upper end of said through hole 23 at proper height, and on the surface of said ladder section 2, an inward protruding furrow ring 26 which is extruded inward to the interior of ladder section 2 is formed at a position properly apart from said outward blocking ring 25. (Please refer to FIG. 3.).

The connection kit 3 has a ringlike covering part 31 and a pivotal joint 32. Said ringlike covering part 31 is horizontally provided on the upper end of the ladder section, and affixed to the ladder section by fastening a screw therein. A plurality of orientation tenons 34 are provided on the inside of said connection kit for engaging with the snap-fit hole 21 of said ladder section, so that the connection kit can be assembled with the ladder section quickly. Also, the inside wall of said connection kit is provided with an adhesive channel 35, wherein the adhesive are infused into the adhesive-infusing hole 36 on its one end so that the connection kit can be firmly adhered to the ladder section 2. Moreover, a via hole 30 is provided on the connection kit for interconnection with the internal channel 37 of said pivotal joint 32.

Said pivotal joint 32 is integrally molded with the ringlike covering part 31, and comprises two vertical side plates 321, 322 having a channel 37 between them, so as to hold a locking mechanism 4; on the inner surface of vertical side plates 321, 322, there are a pair of opposite vertical grooves 38 and two concaves 391, 392, wherein, said vertical grooves 38 are formed at the position near the end of side plates 321, 322; and one of said concave 391 is formed on each of the upper edge of said side plates 321, 322, while the other concave 392 is formed on each of the lower edge of said side plates 321, 322.

The locking mechanism 4 comprises a base locking construction 4*a* and a plurality of upper locking constructions 4*b*. As shown in FIG. 5, each of the upper locking construction 4*b* includes a locking gate 41, a locking bar 42, a spring 43, a turning key 44 and a passive key 45; wherein, said locking gate 41 has a fixing plate 410 for inserting into the vertical grooves 38 formed on said plates 321, 322, at the center of the fixing plate 410, there is a sleeve 413 having an open end facing said via hole 30.

Said locking bar 42 is a cylindric rod, its one end passes through said via hole 30 and said orientation hole 22 formed in said ladder section 2, while the other end can be inserted into said sleeve 413. There is a spring 43 installed between said locking bar 42 and said sleeve 413, then said locking bar 42 would return to its original position by the force of spring 43. On the locking bar 42, there are two mounting grooves to form sectional axes 421, 422 having radius smaller than that of locking bar 42.

Said turning key 44 is formed with a first panel 441 and a second panel being connected in V shape. The upper end of the first panel 441 is formed with a pair of separate arms 443, the space between the separate arms 443 can be used for mounting with the sectional axis 422 of said locking bar 42. the connection portion of said first panel 441 and second panel 442 then is formed with a pair of locking pawl 444 extruded outward from side surfaces. By mounting the locking pawl 444 into said concave 392 formed on the side plates 321, 322 of said ringlike covering part 31, then when the second panel 442 of said turning rod 44 is pushed upward from the lower position, then the locking bar 42 can be moved back and fro by using the locking pawl 444 as axis.

Said passive key 45 has a pushing plate 451 having locking pawls 452 extruded outward from its side ends. Similarly, the locking pawl 452 can be mounted into said concave 391 formed on the side plates 321, 322 of said ringlike covering part 31, in addition, the lower end of said pushing plate 451 is formed with a pair of separate feet 453, the space between the separate feet 453 can be used for mounting with the section axis 421 of said locking bar 42. When the locking bar 42 is horizontally removed, the passive key 45 then can swing to 90 degrees, such that the pushing plate 451 becomes perpendicular to the side plates 321, 322.

When the upper locking construction **4*b* is installed in the pivotal joint 32, the transverse step beam 5 is then provided onto the outside of said pivotal joint 32, on lower face of said transverse step beam 5, there is a hole 51 formed at a position opposite to the second panel 442 of said turning key 44, while a second hole 52 is formed at a position opposite to the said passive key 45, so as to let said pushing plate 451** to extrude upward.

Please refer to FIG. 4, the base locking construction **4*a* has a spring 43, a turning key 44 and a passive key 45 which are identical in structure of the same elements of said upper locking construction 4*b*. The structures of the spring 43, the turning key 44 and the passive key 45 are not repeated herewith. While the structural differences between the base locking construction 4*a* and the upper locking construction 4*b*** are then stated as follows:

As shown in FIG. 4 and FIG. 5, the locking bar 42 of the base locking construction **4*a* not only has a pair of section axes 421, 422 for mounting the corresponding elements of said turning key 44 and passive key 45, but also has a narrow sleeve 423 formed at the section for mounting spring 43 such that a C-shaped clamp 424 can be fixed inside the sleeve 423. And there is a clamping part 425 formed at one end of the locking bar 42. At the position of upper locking construction 4*b* for locating locking gate 41, there is a vertical fixing plate 46 having a via hole 461 at its center part to be inserted into the vertical 38 formed on said plates 321, 322 of said pivotal joint 32**.

In addition, there is installed with a manual control button 47 and a connection rod 48. At the upper end of said manual control button 47, there is a guiding plate 471 having horizontal groove 472 formed at its lower end, such that the guiding plate 471 can be pushed into the shifting hole 53 formed on the lower side of transverse step beam 5, and the manual control button 47 cab be mounted onto the shifting hole 53 to move to and fro on the shifting hole 53.

Furthermore, the central part of manual control button 47 has a furrow 473, so as to connect the manual control button 47 with one end of said connection rod 48 by a pin 474. Said connection rod 48 has the front end penetrates the via hole 461 of said fixing plate 46, and then connect to the clamping part 425 of locking bar 42 by a pin 426. The other end of said connection rod is bent downward, so as to penetrate the shifting hole 53 of said transverse step beam 5 and extend into the furrow 473 of said manual control button 47 to connect together with it.

In addition, the lower end of the ladder section **2*a* is provided with a conical sleeve-shaped buffering device 6. The upper end of said buffering device, by means of a hooked tip 61 provided thereon, is affixed to the opening 24 of said ladder section 2*a*. The lower-end outside of said buffering device is provided with an elastic seal ring 62 to increase friction when it contacts with the inside of said rail and reduce noise. When the ladder section 2*a* is pulled upward, the ladder can be pull extensively, and when the ladder section 2*a* is pushed downward, the elastic seal ring 62 then shall generate a force against the ladder section 2 to slow down the downward movement of ladder. Also, the internal part of said buffering device 6 can be provided with a mylar with its surface having a hole, which allows airs to enter the cavity of said mylar when the buffering device 6** moves upward and downward, and thus enhances the cushion effect.

When the assembling has been completed, as shown in the figures, the bottom of the ladder section 2 is provided with a buffering device 6 and an elastic seal ring 62 to increase the friction between the ladder section and the inside wall of internal ladder section, so that the purpose of slowing down the descending can be achieved. Also, the connection kit and the upper end of said ladder section are provided with adhesive channel 35 to infuse the adhesive therein, so that the connection kit and the ladder section can be adhered to each other. Accordingly, the present extension ladder is assembled integrally and securely. Moreover, the provided locking mechanism 4 is fully covered by the connection kit 3 and the transverse step portion 5, which not only makes it easy and convenient to control the locking mechanism, but also prevents the damage caused by any foreign object.

Figure 3A:
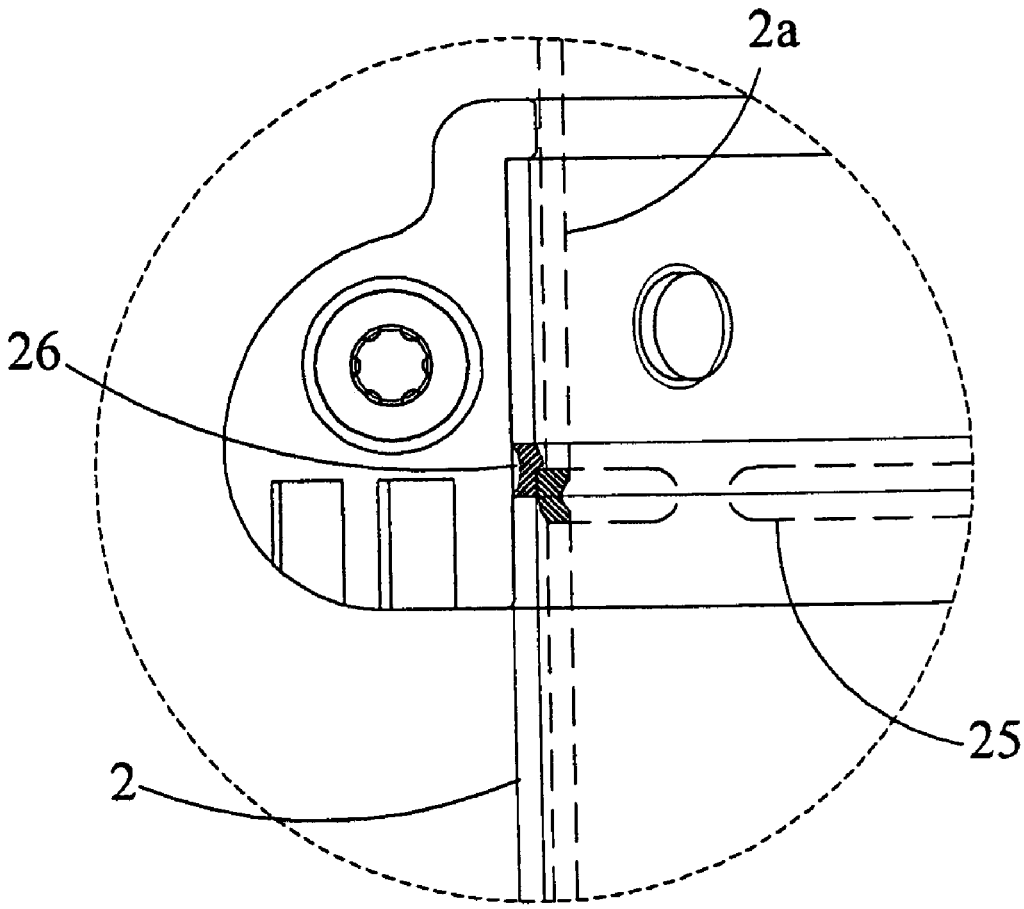
FIG. 3A is a sectional view showing the magnified "A" portion of FIG. 3.

When the internal ladder section **2*a* and ladder section 2 are relatively extended, the blocking ring 25 having a larger caliber on the outside of said internal ladder section 2*a* is firmly against the inwardly protruding furrow ring 26 and to be fixed at its position (as shown in FIG. 3A) in the external ladder section 2. Meanwhile, the through hole on the lower end of said internal ladder section 2*a* is directly located in a route having the orientation hole 22 of said external ladder section, via hole 30 of said connection kit, and locking bar 42, which enables the locking bar 42** to be inserted in the fixed position smoothly when it is moved forward.

Figure 7:
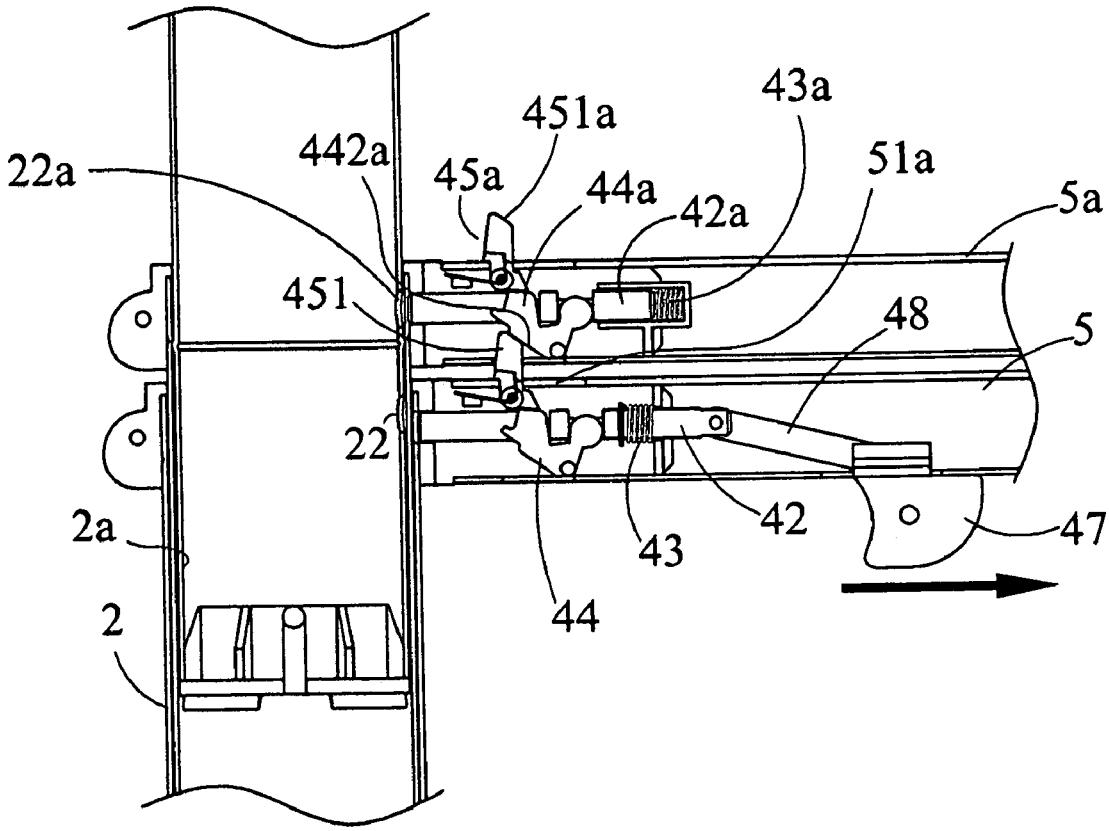
FIG. 7 is a sectional view showing the assembly of the construction of the ladder section and transverse step beam of the present invention.
Figure 8:
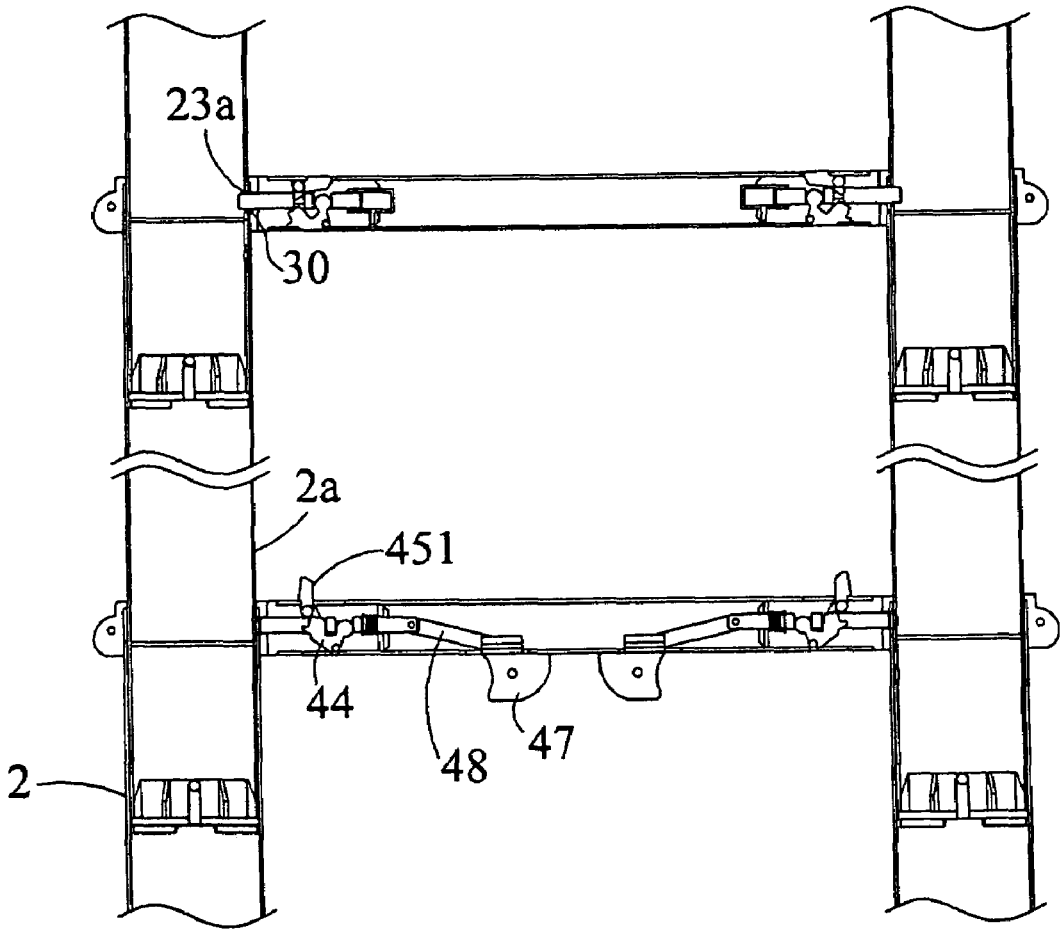
FIG. 8 is a sectional view showing the embodiment of present invention.

In using the present invention, as shown in FIG. 7 and FIG. 8, the manual control button 47 of said base locking construction **4*a* is moved to the central part of said transverse step beam 5, then the connection rod 48 pulls the locking bar 42 out of the orientation hole 22 of said ladder section 2, when the locking bar 42 is moving, said turning key 44 then is pushed to rotate in clockwise direction and said passive key 45 is pushed to rotate in counter-clockwise direction, finally, the pushing plate 451 of said passive key 45 extends outward from the second via hole 52 of said transverse step beam 5**.

Then, the pushing plate 451 of said passive key 45 passes through the via hole 51*a* of second transverse step beam 5*a*, and then pushes the second panel 442*a* of the turning key 44*a* inside the second transverse step beam 5*a*, then the turning key 44*a* rotates clockwisely. At the same time, the turning key 44*a* pushes the locking bar 42*a* inside the second transverse step beam 5*a* moves out of the orientation hole 22*a* of said second ladder section 2. The ladder becomes unlocked and the second ladder 2*a* then can be pulled upward until the passing hole 23*a* of said second ladder section 2*a* is opposite to the via hole 30 of said base ladder section 2*a*, and then the locking bar 42*a* will be inserted into said passing hole 23*a* by the action of spring 43*a*, the second ladder section 2*a* therefore obtains an extended condition. In addition, when the locking bar 42*a* moves out of the orientation hole 22*a* of said second ladder section 2*a*, the passive key 45*a* installed on the second transverse step beam 5*a* then rotates counter-clockwisely, its pushing plate 451*a* then extends outward and continuously pushes the turning key inside the third transverse step beam, such that the locking constructions of other levels are unlocked.

When the locking bar 42 returns to locking position, and the pushing plate 451 of passive key 45 does not completely return to horizontal locking position. If the transverse step beam 5 is mistakenly stepped or pressed downward, the locking bar 42 will be pushed into the ladder section and rigidly locking the construction. Therefore, the present invention has very good functions of security.

Accordingly, the extension ladder with improved structure in the present invention are integrally assembled securely by providing a snap-fit hole 21, orientation tenon 34, and blocking ring 25 between the connection kit 3 and ladder section 2 for quick and correct orientation. Also, the ladder assembly can be securely by providing with the adhesive channel 35. Furthermore, the locking mechanism 4 is provided on the connection kit 3 for making the assembling more convenient, the control of the ladder easier, and prolonging ladder life.

As described above, the extension ladder apparatus in the present invention certainly enhances appliance safety, and makes folding and using quick and convenient, which can improve the deficiencies of conventional ladders. Also, the present invention has not yet opened to public, it is then complied with the conditions of allowable patents.

Although the above-mentioned embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An extension ladder with improved mechanism comprising: a plurality of ladder sections, connection kits, a locking mechanism, and transverse step beams, wherein each ladder section is a hollow rail having different caliber, which can be interconnected by telescoping with each other; its upper end is horizontally provided with a connection kit, while an inside of said connection kit is provided with said locking mechanism covered by said transverse step beam;

Wherein said locking mechanism includes a locking bar which passes through said ladder section, on the locking bar, there are a pair of mounting grooves forming sectional axes; one of said mounting grooves is engaged by a pair of separate arms of a turning key, the other of said of mounting grooves are engaged by a pair of separate feet of a passive key, while one end of said turning key and passive key has respectively a pair of locking pawl extending outwardly from side surfaces of said turning key and passive key, such that when said locking bar moves to and fro, said turning key and passive key then rotates by using said locking pawl as axial center, one end of said passive key is installed with a pushing plate, when said locking bar moves out of said ladder section, said pushing plate then extends outward to push said turning key inside said upper connection kit and then the locking mechanism becomes unlocked.

2. The extension ladder with improved mechanism as claimed in claim 1, wherein said locking mechanism installed inside the connection kit has one end of the locking bar connects to a transversely movable manual control button.

3. The extension ladder with improved mechanism as claimed in claim 2, wherein the upper end of said manual control button has a guiding plate having horizontal groove formed at its lower end, such that said guiding plate can be pushed into a shifting hole formed on the lower side of said transverse step beam, then the manual control button can move at a lower end of said transverse step beam.

4. The extension ladder with improved mechanism as claimed in claim 2, wherein the locking bar has a narrow sleeve formed at the end where said locking bar and connecting rod is connected, such that a C-shaped clamp can be mounted inside said narrow sleeve, there is also a spring mounting onto and end portion of said locking bar, and another end of said spring then pushes against said vertical fixing plate inserted into said connection kit, thereby the locking bar can return to its locking position by the force of the spring after it is moved to unlock the mechanism.

5. The extension ladder with improved mechanism as claimed in claim 1, wherein said locking mechanism installed inside the connection kit has a locking gate to be inserted inside said connection kit, and said locking gate has a fixing plate having a sleeve installed at its central part, the open end of a sleeve is then installed with a spring and a locking bar.

6. The extension ladder with improved mechanism as claimed in claim 1, wherein said ladder section and connection kit are adhered to each other by engaging an orientation hole on the ladder section with an orientation tenon of said connection kit, an then infusing an adhesive into an adhesive channel on the inside of said connection kit.

7. The extension ladder with improved mechanism as claimed in claim 1, wherein a joint of said ladder section and connection kit is provided with an orientation hole to interconnect with a through hole of said connection kit, so that the locking bar of the locking mechanism in said connection kit can be moved forward and backward to the predetermined position through the joint part.

8. The extension ladder with improved mechanism as claimed in claim 3, wherein said connection kit is connected with the ladder section by means of the ringlike covering part, and the pivotal joint on the connection kit is provided with a locking mechanism.

9. The extension ladder with improved mechanism as claimed in claim 8, wherein said pivotal joint of connection kit is integrated with said ring-like covering part, and comprises two vertical side plates.

10. The extension ladder with improved mechanism as claimed in claim 9, wherein said vertical side plates has a channel between them, on the inner surface of said vertical side plates, there are a pair of opposite vertical grooves and a pair of concave surfaces, wherein said vertical grooves are formed near ends of said vertical side plates, and one of said concave surface is formed on each upper edge of said vertical side plates while the other concave surface is formed on each lower edge of said vertical side plates.

11. The extension ladder with improved mechanism as claimed in claim 1, wherein the lower end of said ladder section is provided with a sleeve-shaped buffering device, and an elastic seal ring is provided on a bottom outer rim of said buffering device to maintain friction when it contacts with the inside of one of said rail, and to reduce noise and slow down sliding of the sections.

12. The extension ladder with improved mechanism as claimed in claim 11, wherein the inside of said buffering device is provided with a mylar, on which a hole is formed to enhance the cushion effect by allowing airs to enter into a cavity of said mylar via the holes when the buffering device moves upward and downward.

13. The extension ladder with improved mechanism as claimed in claim 1, wherein a lower section of an internal ladder section is provided with an outward extruded blocking ring, and an inward protruding furrow ring extruded inward to the interior of an external ladder section at the upper section of said ladder section, such that when the internal ladder section and the external ladder section are pulled in opposite directions, said outward extruded blocking ring of said internal ladder section shall move to a position against said inward protruding furrow ring of said external ladder section to define the length of extended ladder.

* * * * *